US007185502B2

(12) United States Patent
Park et al.

(10) Patent No.: US 7,185,502 B2
(45) Date of Patent: Mar. 6, 2007

(54) MULTI-TYPE AIR CONDITIONER AND METHOD FOR CONTROLLING OPERATION OF THE SAME

(75) Inventors: Jong Han Park, Gwangmyeong-si (KR); Young Min Park, Incheon-si (KR); Chang Seon Lee, Seoul (KR); Sung Oh Choi, Gwangmyeong-si (KR); Sung Chun Kim, Seoul (KR); Seung Yong Chang, Seoul (KR); Seok Ho Yoon, Seoul (KR); Baik Young Chung, Incheon-si (KR)

(73) Assignee: LG Electronics Inc, Seoul (KR)

( * ) Notice: Subject to any disclaimer, the term of this patent is extended or adjusted under 35 U.S.C. 154(b) by 379 days.

(21) Appl. No.: 10/729,013

(22) Filed: Dec. 8, 2003

(65) Prior Publication Data

US 2004/0194491 A1 Oct. 7, 2004

(30) Foreign Application Priority Data

Jan. 13, 2003 (KR) ..... 10-2003-0002039

(51) Int. Cl.

| | |
|---|---|
| ***F25D 21/06*** | (2006.01) |
| ***F25B 13/00*** | (2006.01) |
| ***F25B 29/00*** | (2006.01) |
| ***F25B 43/00*** | (2006.01) |

(52) U.S. Cl. ..... 62/80; 62/156; 62/275; 62/324.5; 62/503; 165/233; 165/242

(58) Field of Classification Search ..... 62/275, 62/276, 151, 156, 503, 80, 81, 324.5; 165/240, 165/242, 231, 233, 208

See application file for complete search history.

(56) References Cited

U.S. PATENT DOCUMENTS

| | | | | |
|---|---|---|---|---|
| 5,333,472 | A * | 8/1994 | Bae et al. | 62/503 |
| 5,396,776 | A * | 3/1995 | Kim | 62/503 |
| 5,845,502 | A | 12/1998 | Chen et al. | |
| 6,044,652 | A * | 4/2000 | Nishihara et al. | 165/208 |
| 6,467,284 | B1 | 10/2002 | Chen et al. | |

FOREIGN PATENT DOCUMENTS

| | | |
|---|---|---|
| CN | 2 3 7 6 6 0 3 | 5/2000 |
| JP | 2-258467 | 10/1990 |
| KR | 0 1 5 2 2 8 6 | 5/1994 |

OTHER PUBLICATIONS

English language abstract of CN 2376603.
English Language Abstract of JP 2-258467.
English language Abstract of Korea 0152286.

* cited by examiner

*Primary Examiner*—Marc Norman
(74) *Attorney, Agent, or Firm*—Greenblum & Bernstein, P.L.C.

(57) ABSTRACT

Air conditioner, and method for controlling an operation of the same, the air conditioner including a sheath heater in the accumulator for heating the refrigerant in room heating for delaying deposition of frost on the outdoor heat exchanger. The sheath heater includes a coil formed heat generating part, and two electrodes connected to the heat generating part for supplying power. The method including the step of varying the heat generating rate of the sheath heater with an exterior temperature or a capacity of the indoor unit, thereby delaying deposition of frost on the outdoor heat exchanger.

19 Claims, 4 Drawing Sheets

MULTI-TYPE AIR CONDITIONER AND METHOD FOR CONTROLLING OPERATION OF THE SAME

This application claims the benefit of the Korean Application No. P2003-0002039 filed on Jan. 13, 2003, which is hereby incorporated by reference.

BACKGROUND OF THE INVENTION

1. Field of the Invention

The present invention relates to air conditioners, and more particularly, to an air conditioner which can delay growth of frost on an outdoor heat exchanger, and a method for controlling an operation of the same.

2. Background of the Related Art

In general, the air conditioner cools or heats a room space, such as a residential space, a restaurant, and an office.

The air conditioner in general is provided with an indoor unit and an outdoor unit. The outdoor unit has a compressor, an outdoor heat exchanger, and an accumulator, and the indoor unit has an indoor heat exchanger, and an expansion valve.

When the air conditioner cools a room, the refrigerant flows in an order of the compressor, the outdoor heat exchanger, the expansion valve, and the indoor heat exchanger.

The outdoor heat exchanger serves as a condenser for condensing the high pressure, high temperature gas refrigerant from the compressor. The expansion valve 22 expands the condensed refrigerant into low pressure, low pressure gas refrigerant, and provides to the indoor heat exchanger.

The indoor heat exchanger 21 makes the refrigerant to heat changes with room air to change the refrigerant into two phased refrigerant having low temperature/low pressure gas and liquid refrigerant mixed therein.

On the other hand, when the air conditioner heats the room, the refrigerant compressed at the compressor flows in an order of the indoor heat exchanger, the expansion valve, the accumulator, and the outdoor heat exchanger.

In this instance, the indoor heat exchanger serves as a condenser for making the high pressure, high temperature refrigerant passed through an inside of the indoor heat exchanger to heat exchange with room air, and the outdoor heat exchanger serves as an evaporator for making the low temperature, low pressure refrigerant therein to heat exchange with an outdoor air.

The accumulator serves to prevent introduction of liquid refrigerant into the compressor, only to introduce gas refrigerant into the compressor.

In the meantime, in the heating operation of the air conditioner, it is liable that the heat exchange of the outdoor heat exchanger with surrounding low temperature humid air causes growth of frost on the outdoor heat exchanger. The frost makes the heat exchange of the outdoor heat exchanger with the outdoor air difficult. Therefore, a defrosting operation is carried out, in which refrigerant flow is reversed for removal of the frost.

In the defrosting operation, the refrigerant flows in an order of the compressor, the outdoor heat exchanger, the expansion valve, and the indoor heat exchanger. When the defrosting operation is finished, the heating is started, again.

Thus, the related art air conditioner carries out the defrosting operation in which refrigerant flow is reversed for prevention of growth of frost on the outdoor heat exchanger.

However, the more frequent the defrosting operation, the poorer the operation ratio of the air conditioner, that leads to a poor heating efficiency.

SUMMARY OF THE INVENTION

Accordingly, the present invention is directed to an air conditioner, and a method for controlling an operation of the same that substantially obviates one or more of the problems due to limitations and disadvantages of the related art.

An object of the present invention is to provide an air conditioner which can delay frost deposition on an outdoor heat exchanger, and a method for controlling an operation of the same.

An object of the present invention is to provide an air conditioner which can delay frost deposition on an outdoor heat exchanger, and a method for controlling an operation of the same.

Another object of the present invention is to provide an air conditioner which can prevent waste of energy from a sheath heater, and a method for controlling an operation of the same.

Additional features and advantages of the invention will be set forth in the description which follows, and in part will be apparent to those having ordinary skill in the art upon examination of the following or may be learned from practice of the invention. The objectives and other advantages of the invention will be realized and attained by the structure particularly pointed out in the written description and claims hereof as well as the appended drawings.

To achieve these objects and other advantages and in accordance with the purpose of the present invention, as embodied and broadly described herein, the air conditioner including a compressor, an accumulator on an inlet side of the compressor for introduction of only gas refrigerant into the compressor, an outdoor heat exchanger for heat exchanging between the refrigerant and exterior air, an indoor unit having an indoor heat exchanger for making heat exchange between the refrigerant and room air, and an expansion valve, and a sheath heater in the accumulator for heating the refrigerant in room heating for delaying deposition of frost on the outdoor heat exchanger.

The sheath heater includes a coil formed heat generating part, and two electrodes connected to the heat generating part for supplying power. The two electrodes are waterproof treated for preventing the two electrodes from coming into contact with moisture from the outdoor heat exchanger, or the like.

The sheath heater is formed of copper pipe, and there are a plurality of indoor units.

In another aspect of the present invention, there is provided a method for controlling operation of an air conditioner including the steps of refrigerant from a compressor passing through, and heat exchanging with room air at, an indoor heat exchanger, the heat exchanged refrigerant passing through, and expanding at, an expansion valve, the expanded refrigerant passing through, and heat exchanging with exterior air at, an outdoor heat exchanger, to become low temperature refrigerant, heating the low temperature refrigerant with a sheath heater in an accumulator for delaying growth of frost on the outdoor heat exchanger in room heating, and varying a heat generating rate of the sheath heater with an exterior temperature.

The step of varying a heat generating rate of the sheath heater includes the steps of increasing the heat generating rate of the sheath heater if the exterior temperature is lower than a reference temperature taken as the exterior temperature at which deposition of frost on the outdoor heat exchanger starts, and turning off the sheath heater in a case the exterior temperature exceeds the reference temperature.

The exterior temperature is divided into a plurality of temperature sections, and the heat generating rates of the sheath heater are determined proper to respective temperature sections by experiment.

The sheath heater includes a coil formed heat generating part, and two electrodes connected to the heat generating part for supplying power. The two electrodes are waterproof treated for preventing the two electrodes from coming into contact with moisture from the outdoor heat exchanger, or the like.

The sheath heater is formed of copper pipe.

In further aspect of the present invention, there is a method for controlling operation of an air conditioner including the steps of refrigerant from a compressor passing through, and heat exchanging with room air and expanding at, a plurality of indoor units each having an indoor heat exchanger and an expansion valve, the expanded refrigerant passing through, and heat exchanging with exterior air at, an outdoor heat exchanger, to become low temperature refrigerant, heating the low temperature refrigerant with a sheath heater in an accumulator for delaying growth of frost on the outdoor heat exchanger in room heating, and varying a heat generating rate of the sheath heater with a capacity of the indoor unit.

The step of varying a heat generating rate of the sheath heater includes the steps of increasing the heat generating rate of the sheath heater if the capacity of the indoor unit required in room heating is greater than a reference capacity taken as the capacity of the indoor unit having the smallest capacity of the indoor units, and turning off the sheath heater in a case the capacities of the indoor units is lower than the reference capacity.

The capacity of the indoor unit required in room heating is divided into a plurality of sections, and the heat generating rates of the sheath heater are determined proper to respective sections by experiment.

The sheath heater includes a coil formed heat generating part, and two electrodes connected to the heat generating part for supplying power. The two electrodes are waterproof treated for preventing the two electrodes from coming into contact with moisture from the outdoor heat exchanger, or the like.

The sheath heater is formed of copper pipe, and the heat generating rate of the sheath heater is determined, taking an exterior temperature into account, additionally.

It is to be understood that both the foregoing description and the following detailed description of the present invention are exemplary and explanatory and are intended to provide further explanation of the invention claimed.

BRIEF DESCRITPION OF THE DRAWINGS

The accompanying drawings, which are included to provide a further understanding of the invention and are incorporated in and constitute a part of this application, illustrate embodiment(s) of the invention and together with the description serve to explain the principle of the invention. In the drawings.

DETAILED DESCRIPTION OF THE PREFERRED EMBODIMENT

Reference will now be made in detail to the preferred embodiments of the present invention, examples of which are illustrated in the accompanying drawings. In describing the embodiments, same parts will be given the same names and reference symbols, and repetitive description of which will be omitted.

Figure 1:
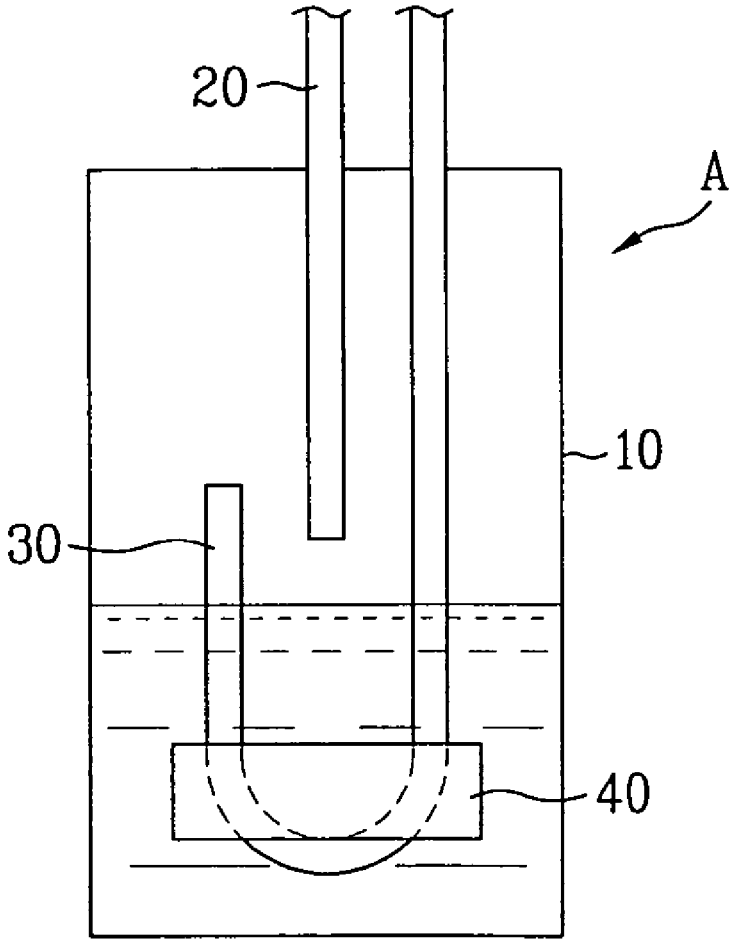
FIG. 1 illustrates an accumulator in an air conditioner in accordance with a preferred embodiment of the present invention, schematically.

Referring to FIG. 1, the air conditioner includes an accumulator 'A' having a heater 40 for delaying growth of frost (deposit of frost) on an outdoor heat exchanger. The accumulator 'A' on an inlet side of the compressor serves introduction of only gas refrigerant to the compressor.

The accumulator 'A' includes a body 10, an introduction pipe 20 for guiding the refrigerant to the body 10, and a discharge pipe 30 for only guiding gas refrigerant in the body to the compressor.

There is a heater 40 in a low part of the discharge pipe 30 for heating the accumulator in heating, for delaying deposition of frost. That is, the heater 40 heats refrigerant passing through the accumulator 'A'. When the refrigerant is heated with the heater 40, refrigerant temperature from the compressor rises, to enhance a heating capability of the air conditioner. Moreover, when the refrigerant is heated, an evaporation temperature of the refrigerant passing through the outdoor heat exchanger also rises, to delay the deposition of frost on the outdoor heat exchanger.

Figure 2:
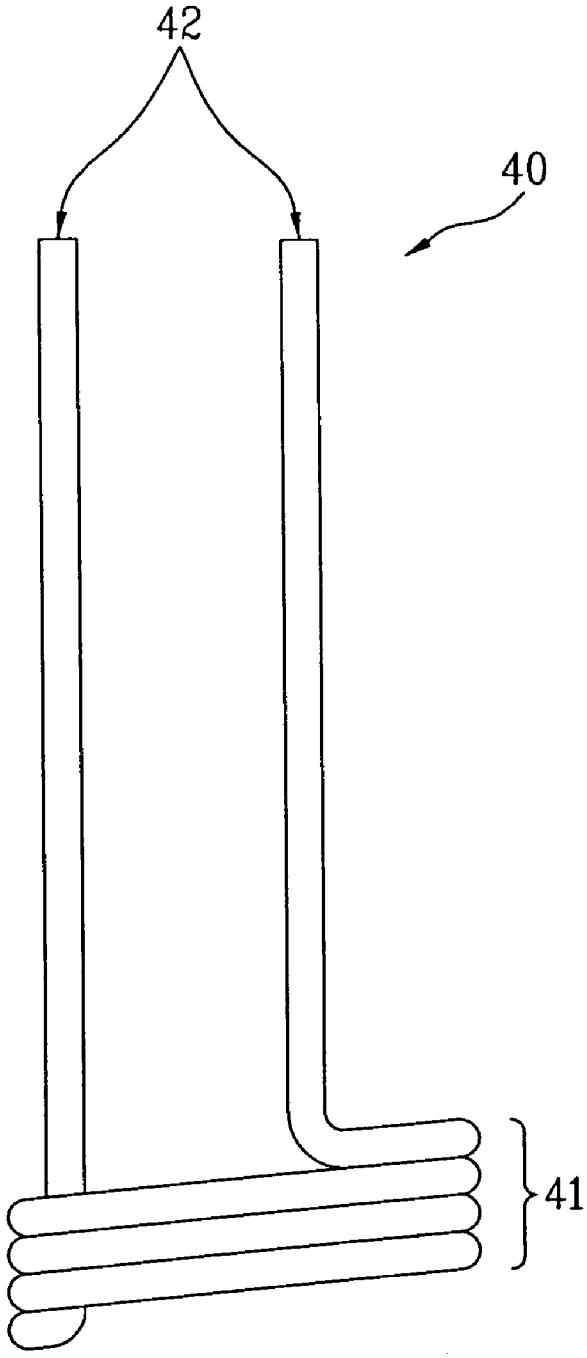
FIG. 2 illustrates a sheath heater in accordance with a preferred embodiment of the present invention.

As the heater 20, a sheath heater 40 as shown in FIG. 2 is used. The sheath heater 40 includes a coil form of heat generating part 41, and two electrodes 42 connected to the heat generating part 41 for supplying power thereto.

The heat generating part 41 includes a hot wire in an inside. Accordingly, the heat generating part 41 emits heat when a power is provided thereto through the two electrodes 42, to heat the refrigerant. Thus, the heat generating part 41 only has coil part. This is because there is a trouble of overheating of a surface of the sheath heater 40 when, not liquid refrigerant, but gas refrigerant comes into contact with the heat generating part 41.

In the meantime, the two electrodes 42 are waterproof treated for preventing the two electrodes 42 from coming into contact with moisture formed at the outdoor heat exchanger, or the like. It is preferable that the sheath heater 40 is formed of a copper pipe for enhancing a heat transfer efficiency.

Figure 3:
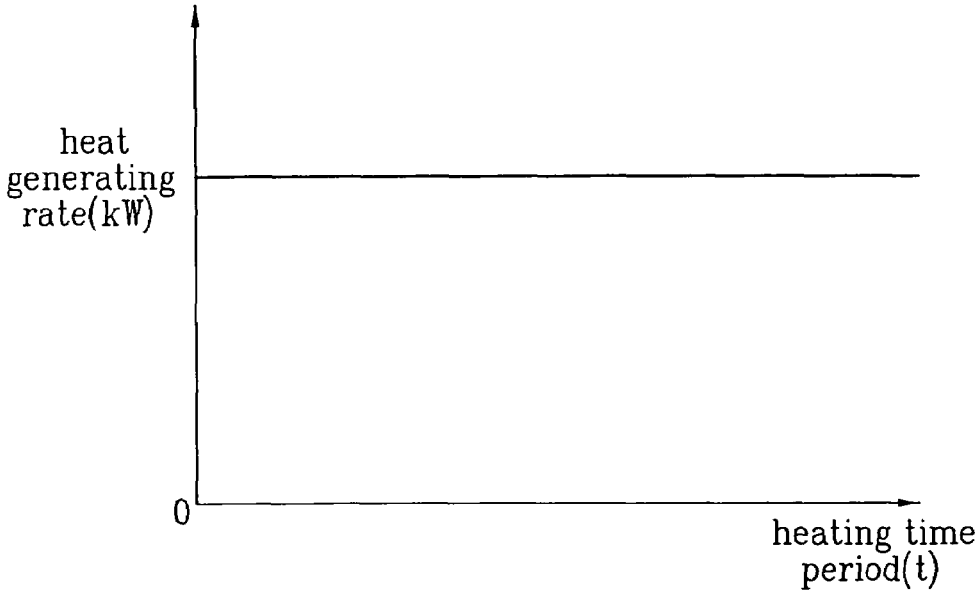
FIG. 3 illustrates a graph showing a heat generation rate of a sheath heater in accordance with a preferred embodiment of the present invention versus a heating operation time period.

Referring to FIG. 3, the sheath heater 40 heats the accumulator 'A' at a fixed heat generation rate during a heating operation, to delay deposition of frost on the outdoor heat exchanger.

However, power consumption of the air conditioner increases as much as the heat provided to the sheath heater 40. Particularly, in a case the same heat is provided to the sheath heater 40 even in a situation no deposition of frost is occurred on the outdoor heat exchanger, there is waste of unnecessary energy.

Figure 4:
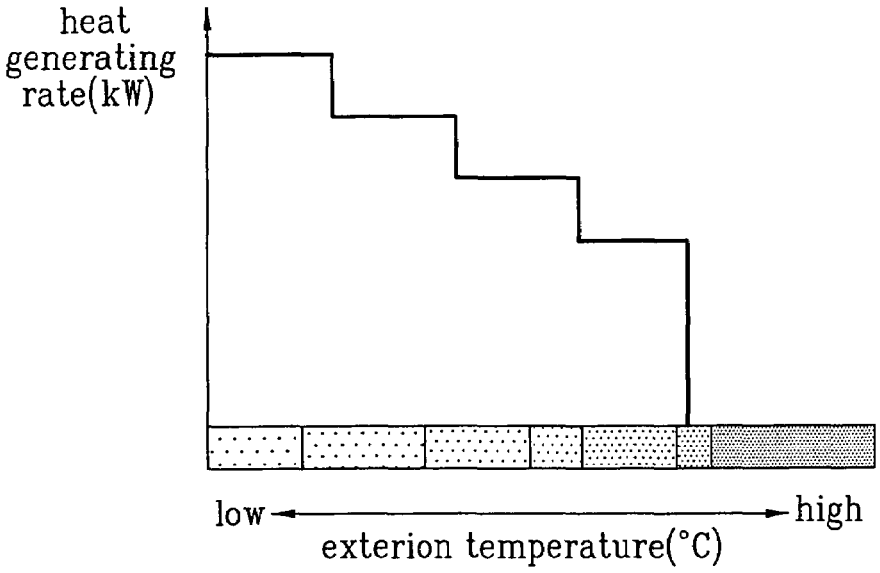
FIG. 4 illustrates a graph showing a heat generation rate of a sheath heater in accordance with a preferred embodiment of the present invention versus an exterior temperature.

Therefore, referring to FIG. 4, in a method for controlling operation of an air conditioner of the present invention, the heat generation rate of the sheath heater 40 is varied with an exterior temperature.

In more detail, in the method for controlling operation of an air conditioner of the present invention, the refrigerant is discharged from the compressor, and passes through, and heat exchanges with room air at, the indoor heat exchanger. Then, the refrigerant is passes through, and expanded at, the expansion valve, and passes through, and heat exchanges with external air at, the outdoor heat exchanger, such that the refrigerant becomes a low temperature refrigerant.

In room heating, for delaying the growth of frost on the outdoor heat exchanger, the low temperature refrigerant is heated with the sheath heater 40 inside of the accumulator 'A'. In this instance, a heat generating rate of the sheath heater 40 varies with an exterior temperature, determined by experiment.

When the heat generation rate of the sheath heater 40 varies, a reference temperature thereof is an exterior temperature at which the deposition of frost on the outdoor heat exchanger starts. Such as reference temperature is determined by experiment, taking not only the exterior temperature at which the deposition of frost starts, but also an exterior humidity that fixes a rate of deposition of frost.

If the exterior temperature is lower than the reference temperature, the heat generation rate of the sheath heater 40 is increased, and if the exterior temperature exceeds the reference temperature, the sheath heater 40 is turned off. Therefore, as the sheath heater 40 is turned off in a temperature range no deposition of the frost takes place owing to a high exterior temperature, waste of unnecessary energy can be prevented.

In the exterior temperature range is divided into a plurality of temperature sections. Heat generating rates of the sheath heater 40 proper to respective temperature sections are determined according to experiment.

Of course, the method for controlling operation of an air conditioner of the present invention is applicable to a multi-type air conditioner having a plurality of indoor units.

Figure 5:
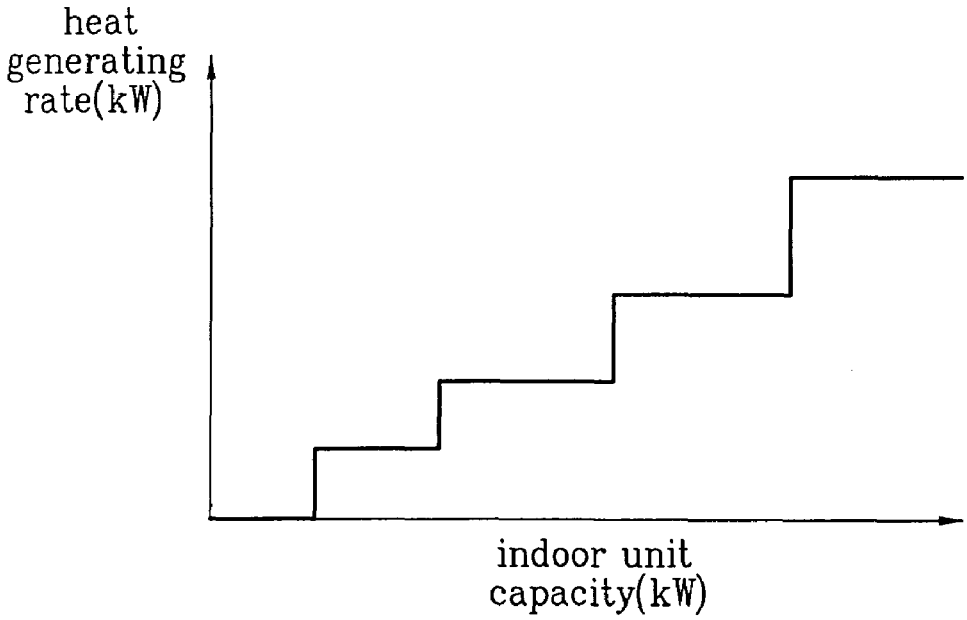
FIG. 5 illustrates a graph showing a heat generation rate of a sheath heater in accordance with a preferred embodiment of the present invention versus a capacity of an indoor unit.

That is, referring to FIG. 5, the method for controlling operation of an air conditioner of the present invention varies the heat generating rate of the sheath heater 40 with a capacity of the indoor unit. A reference capacity of the indoor unit at the time of varying the heat generating rate of the sheath heater 40 is a capacity of the indoor unit having the smallest capacity of the indoor units.

If the capacity of the indoor unit required for heating is greater than the reference capacity, the heat generating rate of the sheath heater 40 is increased, and if the capacity of the indoor unit required for heating is smaller than the reference capacity, the sheath heater 40 is turned off.

What the capacity of the indoor unit is greater than the reference capacity implies that a number of the indoor units that heat rooms are more than one. What the capacity of the indoor unit is smaller than the reference capacity implies that all the indoor units cool the rooms, or inoperative.

The foregoing method for controlling operation of an air conditioner is a method based on a fact that the more a number of indoor units, the greater the heat exchange rate at the outdoor heat exchanger, that increases the deposition of frost on the outdoor heat exchanger too, at the end. Therefore, when the capacity of the indoor unit increases, the heat generating rate of the sheath heater 40 also increases, accordingly.

Moreover, the capacity of the indoor unit required for operation is divided into a plurality of sections, and the heat generating rates of the sheath heater 40 proper to respective sections are determined according to experiment.

The capacity of the indoor unit divided into a plurality of sections is a value fixed according to a number of the indoor units that heat rooms except a case capacities of the indoor units differ. That is, the greater a number of the indoor units that heat the rooms, the greater the capacity of the indoor units. In the meantime, it is preferable that the heat generating rate of the sheath heater 40 is determined taking an exterior temperature into account, additionally.

As has been described, the air conditioner, and a method for controlling an operation of the same have the following advantages.

First, by heating the accumulator with a sheath heater, the frost deposition on the outdoor heater can be delayed.

Second, by increasing/decreasing the heat generating rate of the sheath heater with reference to an exterior temperature or the like, unnecessary waste of energy from the sheath heater can be prevented.

It will be apparent to those skilled in the art that various modifications and variations can be made in the present invention without departing from the spirit or scope of the invention. Thus, it is intended that the present invention cover the modifications and variations of this invention provided they come within the scope of the appended claims and their equivalents.

What is claimed is:

1. An air conditioner, comprising:

a compressor;

an accumulator on an inlet side of the compressor;

an outdoor heat exchanger for exchanging heat between refrigerant and exterior air;

at least one indoor unit having an expansion valve and an indoor heat exchanger for exchanging heat between the refrigerant and room air; and a heater in the accumulator for heating the refrigerant during a room heating mode to delay deposition of frost on the outdoor heat exchanger, wherein the heater is configured to be operated when the exterior temperature is lower than a reference temperature taken as the exterior temperature at which deposition of frost on the outdoor heat exchanger starts and to be stopped when the exterior temperature exceeds the reference temperature.

2. The air conditioner as claimed in claim 1, wherein the heater comprises:

a coil formed heat generating part, and two electrodes connected to the heat generating pad for supplying power.

3. The air conditioner as claimed in claim 2, wherein the two electrodes are waterproof treated for preventing the two electrodes from coming into contact with moisture from the outdoor heat exchanger.

4. The air conditioner as claimed in claim 1, wherein the heater is formed of copper pipe.

5. The air conditioner as claimed in claim 1, wherein the at least one indoor unit comprises a plurality of indoor units.

6. A method for controlling operation of an air conditioner, comprising:

heating low temperature refrigerant with a heater in an accumulator during a room heating mode to delay growth of frost on an outdoor heat exchanger; and varying a heat generating rate of the heater with an exterior temperature, wherein the varying the heat generating rate of the heater by increasing the heat generating rate of the heater when the exterior temperature is lower than a reference temperature taken as the exterior temperature at which deposition of frost on the outdoor heat exchanger starts and by turning off the heater when the exterior temperature exceeds the reference temperature.

7. The method as claimed in claim 6, wherein the exterior temperature is divided into a plurality of temperature sections.

8. The method as claimed in claim 7, wherein the heat generating rates of the heater are determined according to respective temperature sections by experiment.

9. The method as claimed in claim 6, wherein the heater comprises:

a coil formed heat generating part, and two electrodes connected to the heat generating part for supplying power.

10. The method as claimed in claim 9, wherein the two electrodes are waterproof treated for preventing the two electrodes from coming into contact with moisture from the outdoor heat exchanger.

11. The method as claimed in claim 6, wherein the-heater is formed of copper pipe.

12. A method for controlling operation of an air conditioner, comprising:

heating low temperature refrigerant with a heater in an accumulator during a room heating mode to delay growth of frost on an outdoor heat exchanger; and varying a heat generating rate of the heater with a capacity of a plurality of indoor units.

13. The method as claimed in claim 12, wherein the varying the heat generating rate of the heater comprises:

increasing the heat generating rate of the heater when the capacity of the indoor unit required in room heating is greater than a reference capacity taken as the capacity of the indoor unit having the smallest capacity of the indoor units, and turning off the heater when the capacities of the indoor units are lower than the reference capacity.

14. The method as claimed in claim 13, wherein the capacity of the indoor unit required in room heating is divided into a plurality of sections.

15. The method as claimed in claim 14, wherein the heat generating rates of the heater are determined according to respective sections by experiment.

16. The method as claimed in claim 12, wherein the heater comprises:

a coil formed heat generating part, and two electrodes connected to the heat generating part for supplying power.

17. The method as claimed in claim 16, wherein the two electrodes are waterproof treated for preventing the two electrodes from coming into contact with moisture from the outdoor heat exchanger.

18. The method as claimed in claim 12, wherein the heater is formed of copper pipe.

19. The method as claimed in claim 12, further comprising:

determining the heat generating rate of the heater is determined, taking an exterior temperature into account.

* * * * *

UNITED STATES PATENT AND TRADEMARK OFFICE

CERTIFICATE OF CORRECTION

PATENT NO. : 7,185,502 B2
APPLICATION NO. : 10/729013
DATED : March 6, 2007
INVENTOR(S) : J. H. Park et al.

It is certified that error appears in the above-identified patent and that said Letters Patent is hereby corrected as shown below:

At column 8, lines 33-34 (claim 19, lines 3-4) of the printed patent, after "heater" delete "is determined".

Signed and Sealed this

Thirteenth Day of May, 2008

JON W. DUDAS
*Director of the United States Patent and Trademark Office*